United States Patent [19]

Niemiec et al.

[11] 4,008,002

[45] Feb. 15, 1977

[54] VANE PUMP WITH SPEED RESPONSIVE CHECK PLATE DEFLECTION

[75] Inventors: Albin J. Niemiec, Sterling Heights; Raymond B. Pettibone, Troy, both of Mich.

[73] Assignee: Sperry Rand Corporation, Troy, Mich.

[22] Filed: Nov. 7, 1975

[21] Appl. No.: 630,127

[52] U.S. Cl. ..... 417/204; 418/132

[51] Int. Cl.[2] ..... F04B 23/10; F01C 19/08; F04C 15/00

[58] Field of Search ..... 417/204, 300; 418/82, 418/157, 131–135

[56] References Cited

UNITED STATES PATENTS

| | | | |
|---|---|---|---|
| 2,910,944 | 11/1959 | Pettibone | 417/204 |
| 3,311,064 | 3/1967 | Eichele et al. | 418/133 |
| 3,752,609 | 8/1973 | Niemiec et al. | 418/133 |

*Primary Examiner*—John J. Vrablik
*Attorney, Agent, or Firm*—Theodore Van Meter

[57] ABSTRACT

A balanced rotary sliding vane pump has a flexible cheek plate slightly spaced from the rotor and vanes. A hydrostatic pressure pad exposed to outlet pressure urges the cheek plate to deflect toward the rotor and is fully effective at low speeds. A pressure force opposing this deflection at higher speeds is produced by restricting the outlet for fluid discharged by the inwardly moving vanes, thus augmenting the pressure field applied in the clearance space between the rotor and the cheek plate. This speed responsive change in the cheek plate deflection provides for a high volumetric efficiency at slow speeds and also reduces the possibility of cheek plate wear and seizure at higher speeds when volumetric efficiency is less important.

1 Claim, 3 Drawing Figures

VANE PUMP WITH SPEED RESPONSIVE CHECK PLATE DEFLECTION

In the design of rotary sliding vane type pumps for fuel systems in aircraft, the wide range of operating speeds, the low lubricity of the fluid being pumped and the demand for highest efficiency at low speed while avoiding seizures at high speeds present a combination of criteria which are to a considerable extent contradictory and difficult to meet. The requirement for high efficiency at low speed requires close clearances between the stator and rotor, which are best met by flexible cheek plates provided with hydrostatic pressure pads to adjust the clearance in proportion to the delivery pressure encountered. While this well known design feature well meets the low speed efficiency requirements, for example during start-up of a turbojet engine, this design is totally unsuitable for the much higher normal operating speeds during which the heat generated by fluid shear at small clearances as well as the possibility of metal-to-metal contact quickly develops seizures and destruction of the pump.

It is an object of the present invention to provide an improved rotary sliding vane pump especially for use in aircraft fuel systems in which high efficiency at low speeds is assured without at the same time causing excessive heat generation and consequent seizures at the higher operating speeds.

It is also an object to provide a vane pump construction having a flexible cheek plate which is responsive to pump speed in a manner which will provide reduced clearances at low speeds and will increase those clearances as the pump speed increases.

These objects are achieved by the provision of a balanced vane pump comprising a body having an inlet and an outlet and a driveshaft journalled therein, a cam ring secured in the body, a rotor driven by the shaft and carrying a plurality of slidable vanes, a flexible cheek plate having a first face adjacent an end face of the rotor and a side of the vanes with a second face adjacent the body, fluid discharge grooves in the first face of the cheek plate in the arcs through which the vanes move radially inwardly, hydrostatic pressure pads adjacent the second face of the cheek plate at the aforesaid arcs and in open communication with the outlet, and restricted passages between the discharge grooves and the pressure pads whereby the cheek plate will be deflected toward the rotor at low speeds to provide a minimal rotor-cheek plate clearance and will be less deflected at higher speeds to provide increased rotor-cheek plate clearance.

Figure 1:
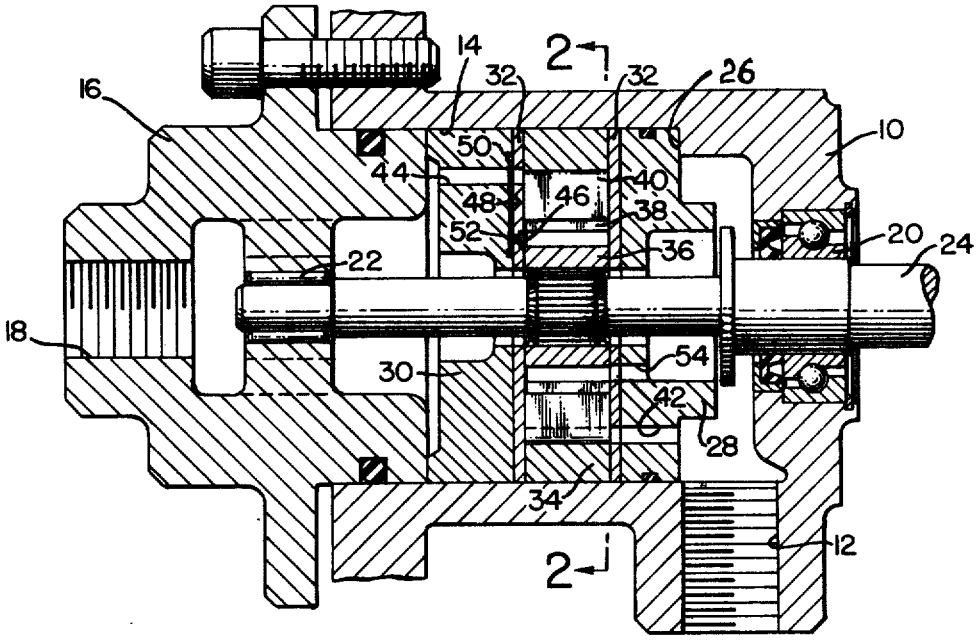
FIG. 1 is a longitudinal quarter section of a balanced rotary vane pump incorporating a preferred form of the present invention.

The pump of the present embodiment comprises a body 10 having an inlet connection 12 and a cylindrical cavity 14 which is closed by an end cap 16 having an outlet connection 18. Journalled in bearings 20 and 22 is a driveshaft 24. Clamped in the bore 14 between a shoulder 26 and the end cap 16 is a pumping cartridge consisting of the inlet plate 28 and the outlet plate 30, the cheek plates 32 and the cam ring 34. The pumping cartridge also includes a rotor 36 splined to the shaft 24 and having a plurality of slots 38 in which vanes 40 are radially slidable. The inlet plate 28 has arcuate inlet ports 42 registering with corresponding ports in the cheek plates 32. The outlet plate 30 has a pair of arcuate delivery ports 44 which register with corresponding ports in the adjacent cheek plate 32. The structure thus far described is but one representative of a variety of rotary vane pumps in which the improvement represented by the present invention may be incorporated.

Figure 2:
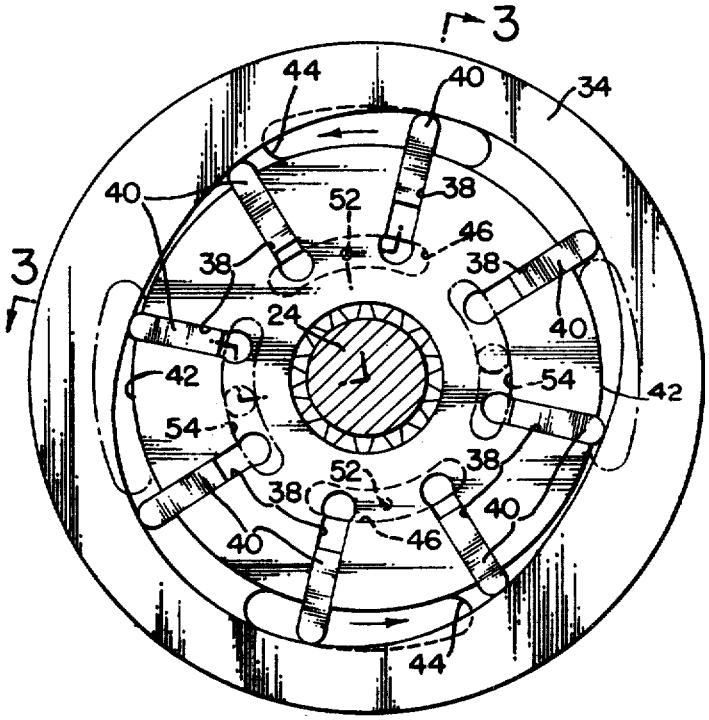
FIG. 2 is an end view of the pumping cartridge taken along line 2—2 of FIG. 1.
Figure 3:
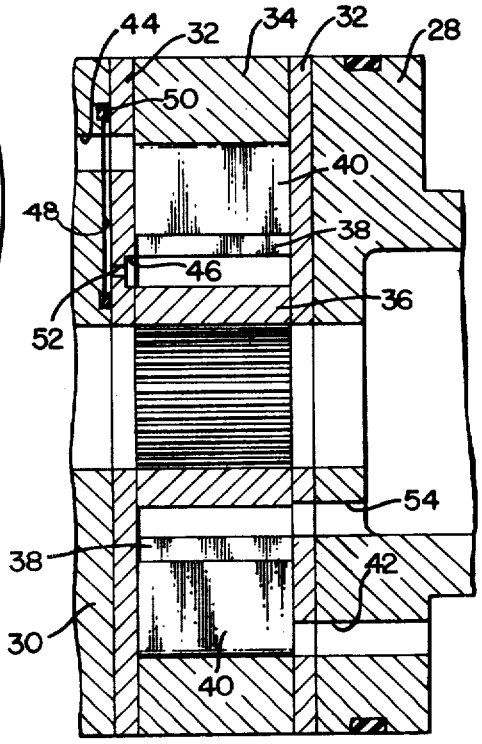
FIG. 3 is a sectional view on line 3—3 of FIG. 2.

Referring now to FIGS. 2 and 3, the cheek plate 32 in this case the left-hand one in FIG. 1, has a pair of fluid discharge grooves 46 on its face adjacent the rotor 36 which extend over the arc within which the vanes 40 move inwardly as the rotor moves clockwise in FIG. 2. These grooves 46 receive the fluid "pumped" by the vanes moving into their slots. The discharge plate 30, or optionally the back face of the cheek plate 32, has a hydrostatic pressure pad 48 enclosed by an O-ring 50 at each discharge port 44, the area of which is chosen to substantially overbalance the pressure field between rotor and cheek plate generated by the discharging fluid. Restricted passages 52 extend from the grooves 46 through the pressure plate to the hydrostatic pressure pads 48. The usual undervane fluid feeding grooves 54 are provided at the intake arcs.

In operation, the pumping action when the shaft 24 is driven is similar to that of a conventional balanced rotary sliding vane pump. The flexible pressure plate 32 at the left side is deflected by delivery pressure in the hydrostatic pad 48 to maintain a close clearance with the rotor and the sides of the vanes. At the slower speeds, which occur during engine start-up, the volume of fluid being pushed out from under the vanes 40 into the delivery grooves 46 passes through the restricted orifices 52 without significant pressure build up so that the pressure field in the rotor-cheek plate clearance is readily overcome by the delivery pressure acting over the full area of the hydrostatic pressure pads 48. Thus, the cheek plate achieves its fullest deflection under these conditions.

However, as the speed of the shaft 24 increases and comes up to normal running speed, restriction 52 causes a pressure build up in the grooves 46 which causes a corresponding expansion of the force exerted by the pressure field in the rotor-cheek plate clearance. This opposes the deflection force exerted over the area of the hydrostatic pads 48, allowing the previous deflection of the cheek plate 32 to relax either partially or even completely as the very higher speeds are reached. Thus, although the pump volumetric efficiency is reduced by this action, it is immaterial so far as the fuel requirements of the jet engine are concerned since the volume delivered at the greatly increased speed is more than required. However, the increase in rotor-cheek plate clearance reduces the heat generated by fluid shear in that clearance and also eliminates the possibility of metal-to-metal contact. Both of these factors eliminate or greatly reduce the possibility of pump seizure.

We claim:

1. A balanced vane pump comprising a body having an inlet and an outlet for the pumped fluid and a driveshaft journalled therein, a cam ring secured in the body, a rotor driven by the shaft and carrying a plurality of slidable vanes, a flexible cheek plate having a first face adjacent an end face of the rotor and a side of the vanes with a second face adjacent the body, having fluid inlet openings in the first face of the cheek plate in the arcs through which the vanes move radially outwardly, having fluid discharge grooves in the first face of the cheek plate in the arcs through which the vanes move radially inwardly, hydrostatic pressure pads adjacent the second face of the cheek plate at the aforesaid arcs and in open communication with the outlet, and restricted passages between the discharge grooves and the pressure pads, dimensioned to provide negligible pressure drop to the flow occuring at low pump speeds but to provide significant and increasing pressure drop at higher pump speeds, whereby the cheek plate will be deflected toward the rotor at low speeds to provide a minimal rotor-cheek plate clearance and will be less deflected at higher speeds to provide increased rotor-cheek plate clearance.

* * * * *